United States Patent [19]

Garris

[11] Patent Number: 4,622,914

[45] Date of Patent: Nov. 18, 1986

[54] APPARATUS FOR TREATING A MOVABLE SURFACE

[75] Inventor: Vladimir A. Garris, Rochester, N.Y.

[73] Assignee: Eastman Kodak Company, Rochester, N.Y.

[21] Appl. No.: 727,461

[22] Filed: Apr. 26, 1985

[51] Int. Cl.[4] ..... B05C 11/00; G03G 21/00

[52] U.S. Cl. ..... 118/77; 118/652

[58] Field of Search ..... 118/652, 76, 77, 203, 118/210, 223; 15/256.52; 355/15

[56] References Cited

U.S. PATENT DOCUMENTS

| | | | |
|---|---|---|---|
| 3,501,294 | 3/1970 | Joseph | 430/125 |
| 3,810,776 | 5/1974 | Banks et al. | 427/194 |
| 3,973,843 | 8/1976 | Linblad et al. | 355/3 R |

FOREIGN PATENT DOCUMENTS

| | | | |
|---|---|---|---|
| 56-161577 | 12/1981 | Japan | 118/652 |

*Primary Examiner*—Evan K. Lawrence
*Attorney, Agent, or Firm*—Milton S. Sales

[57] ABSTRACT

Apparatus is disclosed for treating a movable surface with material which has been removed from an erodable bar of such material. A movable applicator is adapted to brush against the bar and to transfer eroded material to the movable surface. The bar is cylindrical and mounted for rotation about its longitudinal axis to present a continuously changing portion of its periphery to the applicator. By causing the bar to rotate, the peripheries of the applicator and the bar move at relative speeds less than that which would cause objectionable dusting to occur. The bar is mounted for movement generally toward the rotatable applicator to maintain contact therebetween as the bar wears. The pressure between the bar and the applicator is maintained partially by gravitational force and partially by magnetic force.

6 Claims, 4 Drawing Figures

FIG. 1
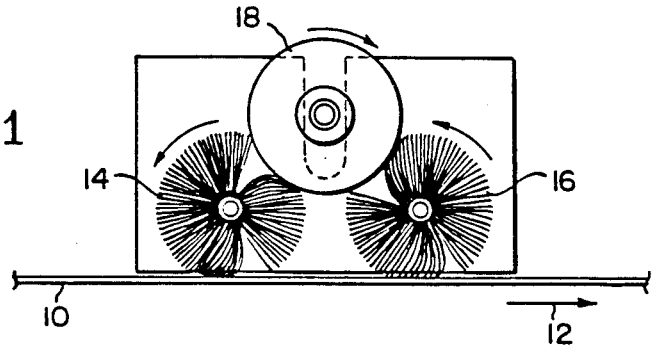
FIG. 2
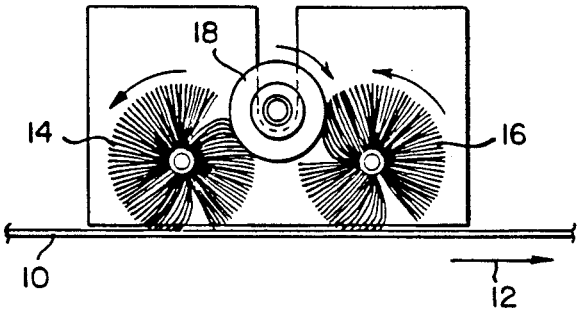
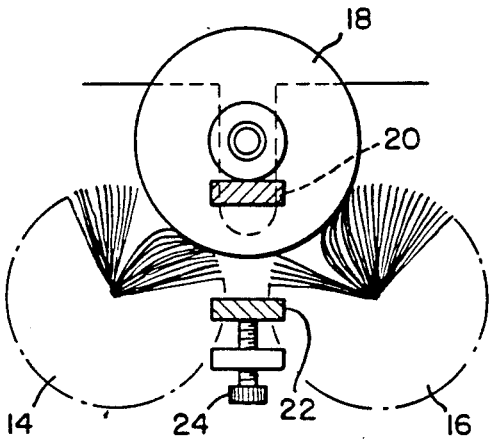
FIG. 3
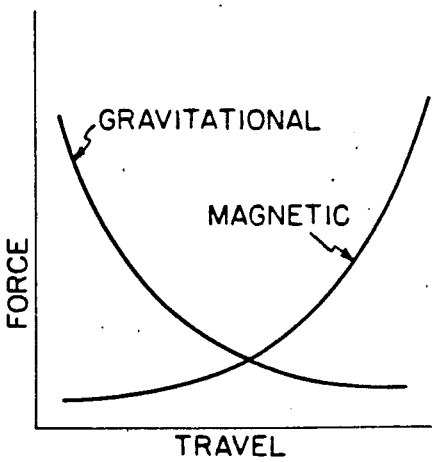
FIG. 4

APPARATUS FOR TREATING A MOVABLE SURFACE

BACKGROUND OF THE INVENTION

1. Field of the Invention

This invention relates to apparatus for treating a movable surface with material which has been removed from a bar of such material. Preferably, the apparatus is used for coating photoconductive members with a low surface adhesion material.

2. Description of the Prior Art

Electrographic copiers typically make document reproductions by exposing an electrically charged photoconductive member to a light image of the document. The light image selectively discharges the photoconductive member to form a latent image charge pattern corresponding to the document. An oppositely charged developer material is brought into contact with the latent image to develop the image. The developed image is then transferred to a receiver sheet and fixed to the sheet by heat and/or pressure to yield the desired copy.

The developer material includes a resinous powder known as toner. If all the toner particles are not transferred to the receiver sheet, and some remain on the photoconductive member, the residual toner may be transferred to subsequent receiver sheets resulting in copies with "ghost" images or high density backgrounds. It is therefore standard practice to include apparatus for cleaning the photoconductive member immediately after image transfer.

One of the most commonly used cleaning apparatus for photoconductive members includes a rotating bristle brush which sweeps residual toner particles from a photoconductive member. Typical cleaning apparatus are shown and described in U.S. Pat. Nos. 3,615,813; 3,838,922; and 4,099,861. In practice however, toner oftentimes is not completely removed from the photoconductive member by the cleaning apparatus.

U.S. Pat. No. 3,973,843, which issued on Aug. 10, 1976 to N. R. Lindblad et al., discloses apparatus for treating a photoconductive member with a lubricant to facilitate removal of toner particles from the photoconductive member. Lubricant is applied to the imaging surface from an erodable bar either through direct contact of the bar to the imaging surface or through an intermediary fiberous web or rotating brush which erodes lubricant from the bar and carries it to the imaging surface. The Linblad et al. patent discloses the use of phthalic acid, isophthalic acid, terephthalic acid, or the metal or ammonium salts thereof as lubricating compounds.

U.S. Pat. No. 3,501,294, which issued on Mar. 17, 1970 to R. J. Joseph, refers to the treatment of the imaging surface of a photoconductive member with a solid hydrophobic metal salt of a fatty acid such as zinc stearate to promote both the transfer of toner particles from the imaging surface to receiver sheets, and the removal of toner particles from the imaging surface by cleaning devices. In U.S. Pat. No. 3,810,776, which issued May 14, 1974 to B. R. Banks et al., offset of toner to a heated fusing roll is prevented by coating the roll with an adhesion-preventing layer of an immiscible dispersion of a high viscosity, low surface tension component such as zinc or aluminum stearate or behenate and low viscosity, low surface tension component such as 50 centipoise silicone oil.

Although applicators as disclosed in the Linblad, Joseph, and Banks et al. patents do provide a relatively non-adhesive surface, they also create certain problems and impose certain limitations on the machine operation. Each of the proposed applicators employs an erodable bar for supplying lubricant to the imaging surface (or to the fusing roll in the case of Banks et al.). The lubricant bar is necessarily the width of the imaging surface. In some machines the bar may be as long as 17 inches or more. As the bar erodes, it becomes tapered. The lubricant is quite brittle, and the tapered edge of the bar is subject to chipping or crumbling as the bar wears. The crumbled pieces are a contaminant in the copier environment. It is a feature of the present invention to provide for even wear of the bar, thereby inhibiting crumbling.

Also, the presence of a lubricant bar imposes a limitation of the speed at which the photoconductive member may move. The bar erodes by being abraded into a powder by the applicator brush. Relative movement between the brush and the bar and between the brush and the imaging surface of the photoconductive member scatters the powder and creates dust in the machine environment. The greater the relative speeds at these two interfaces, the more dust is created. The speed of the photoconductive member must be kept below that which would produce an objectionable amount of dust. It is a feature of the present invention to provide for greatly increased photoconductor speed without increasing the relative speed at the brush/photoconductor and brush/bar interfaces.

The rate of material application is controlled in part by the pressure between the bar and the brush. As the bar erodes, it must be fed forward toward the brush, and complicated feeding mechanisms have been proposed by others. Gravity feed would be less complicated, but would result in a lessening of the pressure between the bar and the brush as the bar looses weight through erosion. It is a feature of the present invention to provide a simple feed mechanism for the erodable bar.

SUMMARY OF THE INVENTION

In accordance with the present invention, there is provided apparatus for treating a movable surface with material which has been removed from an erodable bar of such material. A movable applicator is adapted to abrade the bar and to transfer eroded material to the movable surface. The erodable bar is cylindrical and mounted for rotation about its longitudinal axis to present a continuously changing portion of its periphery to the applicator. Since the bar rotates as it erodes, it erodes evenly about its circumference and there is no wearing away of the bar such as to cause it to have a tapered configuration, which would tend to chip or crumble. That is, the cross-sectional shape of the bar remains substantially circular.

By causing the bar to rotate, the peripheries of the applicator and the bar move at relative speeds less than that which would cause objectionable dusting to occur.

The erodable bar is mounted for movement generally toward the rotatable applicator to maintain contact therebetween as the bar wears. The pressure between the bar and the applicator is maintained partially by gravitational force and partially by magnetic force. The magnetic force is derived by magnets positioned such that the magnetic force increases as the bar approaches the applicator. Therefore, while erosion of the bar material decreases the gravitational force, it positions the bar to increase the magnetic force, thereby maintaining a generally constant force urging the bar toward the applicator.

BRIEF DESCRIPTION OF THE DRAWINGS

The invention will become more readily apparent from the following detailed description of the preferred embodiments, illustrated by way of example in the accompanying drawings, in which:

FIG. 1 is a schematic illustration of a surface treating apparatus in accordance with a preferred embodiment of the present invention;

FIG. 2 is a view similar to FIG. 1 showing the position of elements after the bar is eroded;

FIG. 3 is an enlarged view of a portion of the apparatus shown in FIG. 1, showing additional elements; and FIG. 4 is a graph schematically showing forces acting upon a part of the device illustrated in FIGS. 1–3.

DETAILED DESCRIPTION OF THE PREFERRED EMBODIMENT

Referring to FIG. 1, a member 10 is supported for movement in the direction of arrow 12. In the illustrative embodiment, member 10 is a flexible transparent photoconductive member of an electrographic copier, but the present invention is suitable to the treating of other members. The upper surface of photoconductive member 10 is an imaging surface, and is contacted by driven rotating cylindrical treatment brushes 14 and 16. The axial lengths of brushes 14 and 16 correspond approximately to the width of member 10.

A cylindrical bar 18 of erodable composition to be transferred to the surface of member 10 is positioned above the plane defined by the axes of brushes 14 and 16. The bar is mounted for rotation about its longitudinal axis parallel to that plane, and is movable downwardly toward the plane by gravity and, as explained below, by magnetic force so that it is urged into contact with the brushes. Thus, as the bar is consumed, its longitudinal axis will move toward the plane of the axes of brushes 14 and 16 (FIG. 2). Since bar 18 rotates, it constantly presents a different part of its periphery to the brushes and wears uniformly around its periphery. This inhibits the formation of tapered edges and the like, which would tend to crumble.

As bar 18 erodes, a powdery substance is transferred from the bar to brushes 14 and 16, and from the brushes to member 10. If the relative surface speed between bar 18 and brushes 14 and 16, and between the brushes and member 10 is too great, an objectionable amount of dust is produced, polluting the machine environment. The existence of dust in electrographic copiers is a serious problem. Means, not shown, are provided for driving brushes 14 and 16 at angular speeds such that a maximum relative velocity of each brush over member 10 is not exceeded. The maximum relative velocity between the brushes and the surface of member 10 is such so as to inhibit an unacceptable amount of dusting. Second drive means (not shown) are provided for driving bar 18 at no more than a maximum rotational speed such that the relative surface speeds of the bar and brushes are less than that which would cause objectionable dusting.

In the illustrated example the speed of member 10 is determined without concern for the dusting problem. Brushes 14 and 16 are driven at sufficient angular velocities, empirically determined such that the relative speed between the brushes and member 10 is within acceptable limits. The rotational speed of bar 18 is determined in a similar manner. As such, the maximum speed of member 10 is no longer limited by acceptable dusting limitations.

The gravitational force urging bar 18 against brushes 14 and 16 is reduced as the bar is consumed and weight is lost. Yet, the maintenance of a generally constant pressure between bar 18 and the brushes is critical to control the amount of material removed from the bar. To compensate for the weight reduction, a pair of opposed magnets 20 and 22 (FIG. 3) are positioned so as to add to the gravitational force magnet 20 being carried by bar 18. As the bar is consumed and moved toward the plane of the brush axes, the magnets approach each other and their attractive force increases. The space between magnets 20 and 22 can be adjusted by screw 24. As shown in FIG. 4, the magnets and their positions can be selected so that the increase in magnetic force as the bar is consumed is such as to generally compensate for the loss in weight of the bar; keeping the pressure between the bar and the brushes substantially constant during the consumption of the bar.

While the invention has been particularly shown and described with reference to preferred embodiments thereof, it will understood by those skilled in the art that various changes in form and details may be made therein without departing from the spirit and scope of the invention.

I claim:

1. In apparatus for treating a movable surface with material from an abradable source of such material, the apparatus including a movable applicator adapted to brush against both the source and the surface (1) to abrade the source and thereby erode material from the source and (2) to transfer eroded material to the surface, the improvement wherein the source is a cylindrical bar of erodable material mounted for rotation about its longitudinal axis, whereby a continuously changing portion of its periphery is presented to the applicator such that erosion of said bar is substantially uniform about said periphery.

2. The apparatus as set forth in claim 1 further comprising:

means for moving said applicator relative to said surface at a speed less than that which would cause objectionable dusting; and means for rotating said source relative to said applicator at a speed less than that which would cause objectionable dusting.

3. The apparatus as set forth in claim 1 wherein said source is adapted to shift in a direction normal to its longitudinal axis toward said applicator as the source erodes.

4. The apparatus as set forth in claim 3 wherein said shifting is partially by gravitational force, and further comprising magnetic means for supplementing the gravitational force.

5. The apparatus as set forth in claim 3 further comprising magnetic means for urging said source to shift toward said applicator.

6. The apparatus as set forth in claim 3 wherein said source is adapted to shift toward said applicator by gravity, and further comprising magnetic means for urging said source to shift toward said applicator, said magnetic means operable to effect an increasing force as said source erodes and thereby decreases in weight, whereby, as said source erodes, said shifting is effected in part by a decreasing gravitational force and in part by an increasing magnetic force.

* * * * *